US006624736B1

(12) United States Patent
Cotton et al.

(10) Patent No.: US 6,624,736 B1
(45) Date of Patent: Sep. 23, 2003

(54) FUSE HOUSING WITH RATE RELEASE CONTROL PLUG

(75) Inventors: John F. Cotton, Jackson, TN (US); Frank D. Wolfe, Jackson, TN (US)

(73) Assignee: ABB Inc., Raleigh, NC (US)

( * ) Notice: Subject to any disclaimer, the term of this patent is extended or adjusted under 35 U.S.C. 154(b) by 0 days.

(21) Appl. No.: 09/574,789

(22) Filed: May 19, 2000

(51) Int. Cl.[7] ..... H01H 85/43; H01H 85/02

(52) U.S. Cl. ..... 337/203; 337/205; 337/252; 337/204; 361/835

(58) Field of Search ..... 337/203, 204, 337/205, 251–254, 210, 211, 280, 186, 194; 361/104, 626, 642, 835, 837

(56) References Cited

U.S. PATENT DOCUMENTS

| | | | | | |
|---|---|---|---|---|---|
| 1,104,723 | A | | 7/1914 | Weiss | |
| 1,996,423 | A | | 4/1935 | Jansson | 173/318 |
| 2,918,557 | A | * | 12/1959 | Link | 337/194 |
| 3,123,783 | A | | 3/1964 | Wilk et al. | 336/55 |
| 3,244,838 | A | * | 4/1966 | Astleford, Jr. | 337/224 |
| 3,365,616 | A | * | 1/1968 | Hermann | 361/41 |
| 3,772,624 | A | | 11/1973 | Keogh | 336/55 |
| 3,781,746 | A | * | 12/1973 | Cuzzone | 337/204 |
| 4,010,437 | A | * | 3/1977 | Macemon et al. | 337/204 |
| 4,150,353 | A | * | 4/1979 | Huber et al. | 337/231 |
| 4,220,941 | A | | 9/1980 | Mahieu | 337/250 |
| 4,365,227 | A | * | 12/1982 | Trayer | 337/202 |
| 4,373,772 | A | * | 2/1983 | Lorenzen et al. | 339/130 R |
| 4,609,900 | A | | 9/1986 | Bachhofer et al. | 336/58 |
| 5,204,654 | A | * | 4/1993 | Hay | 337/204 |
| 5,227,758 | A | * | 7/1993 | Ranjan | 337/204 |
| 5,709,289 | A | | 1/1998 | Peter et al. | 188/298 |
| 5,936,507 | A | | 8/1999 | Borck et al. | 337/204 |

* cited by examiner

*Primary Examiner*—Anatoly Vortman
(74) *Attorney, Agent, or Firm*—Woodcock Washburn LLP

(57) ABSTRACT

A fuse housing assembly is disclosed that includes a rate release plug that prevents the emission of large quantities of dielectric oil from a transformer tank upon removal of a fuse holder from a bayonet-type fuse holder. The rate release plug allows pressurized gas inside the tank to escape while at the same time, impeding the flow of dielectric oil out of the tank.

5 Claims, 7 Drawing Sheets

FUSE HOUSING WITH RATE RELEASE CONTROL PLUG

FIELD OF THE INVENTION

This invention generally relates to fuse housing assemblies for liquid-cooled transformers. More particularly, the invention relates to a vent plug positioned in a vent hole of a fuse holder housing assembly which prevents large quantities of transformer oil from being ejected, but still allows for venting of the gas buildup, when the fuse holder is removed.

BACKGROUND OF THE INVENTION

A bayonet-type fuse assembly is one mechanism to protect a transformer or an electric circuit from excessive current. The fuse will serve to protect the transformer or electrical system by short circuiting and disrupting the flow of electricity upon overload or system failure. In such an assembly, the fuse is designed to operate under a dielectric oil, such as mineral oil, within the transformer. This submersion is ideal as it helps to extinguish any electrical arc between the conductive opposite ends of the fuse when the fuse operates or melts in response to excessive current.

In a conventional bayonet-type fuse assembly, a cylindrical housing of electrically insulating material protrudes into the transformer at a downward angle such that a portion of the housing is located on the interior of the transformer and a portion of the housing is located on the exterior of the housing. In order for the fuse to be submersed in the oil inside the transformer, it is necessary that at least some portion of the housing on the interior of the transformer be submersed in the oil as well.

In order for the fuse housing assembly to receive the fuse, a bayonet-type fuse holder will have an attached fuse cartridge. This fuse holder may be inserted into the interior of the cylindrical fuse housing such that upon pushing the fuse holder into the fuse housing, the fuse becomes submersed in oil in the interior portion of the transformer and is in contact with a pair of contacts. The portion of the fuse holder on the exterior of the transformer will seal the fuse housing when the holder is inserted into the housing. After the fuse has operated, the fuse holder and attached fuse may be removed from the fuse housing. The fuse may then be replaced and the holder reinserted to permit the transformer to operate.

During operation transformers can become extremely hot as a result of high load conditions, as well as high ambient temperatures. Upon an increase in the temperature of the transformer, the dielectric oil in the interior of the transformer will expand and the transformer can become highly pressurized. As the volume of the oil changes in light of the surrounding conditions, it is apparent that the level of the oil in the interior of the transformer will fluctuate as well. This fluctuation presents difficulties when removing the fuse holder as it is possible that the oil level may approach the level of the opening of the fuse housing assembly, or may even rise above it. Upon removal of the fuse holder, there is the possibility of a loss of oil because of the higher level of oil in the transformer combined with the difference in pressure between the inside of the transformer and the outside atmosphere. Because of the high temperature of the oil inside the transformer, a loss of oil, especially in large quantities, can result in a dire safety hazard for those servicing the transformer. In fact, it is quite possible that a high velocity liquid stream of hot oil may emit from the portion of the fuse housing on the exterior of the transformer.

Because it is necessary for the fuse to be in contact with the dielectric oil inside the transformer when functioning, a loss of oil resulting from replacement of a fuse is highly undesirable. A loss of oil such that a functioning fuse inside the transformer is exposed to air can cause a serious hazard to those servicing the transformer as an arc between the upper contact and the transformer wall can result.

Numerous attempts have been made to remedy the above-mentioned problem. One attempt to address this problem is by utilizing a pressure relief valve which operates automatically upon an increase in pressure in the interior of the transformer, but this valve does not entirely remedy the problem. It is common that the pressure inside the transformer is such that it falls between the pressure outside the transformer and the pressure at which the valve will automatically operate. Such a slight differential in pressure between the interior and exterior of the transformer is still sufficient to cause hot oil to be emitted from the transformer upon removal of the fuse holder. Also, some transformers do not contain a pressure relief valve.

Instead of utilizing a pressure valve that operates automatically, other transformers utilize a manually operated pressure relief valve. In such a case, the individual changing the fuse can bleed pressure from the transformer prior to removing the fuse holder. Again the problem of the emission of large quantities of oil is not entirely solved as it may be the case that the instant of time between releasing the manual pressure valve and removing the fuse holder from the housing is enough time to allow the pressure to build up enough to still emit hot oil. There is also the possibility that the operator may neglect to utilize the manually operated pressure relief valve.

Another attempt to prevent the emission of hot oil from a transformer includes the use of a spring-loaded arm and stopper mounted in the fuse housing that seals a portion of the housing when the fuse holder is removed. Such a device is disclosed in U.S. Pat. No. 5,204,654, the entire disclosure of which is incorporated by reference herein. This "flapper" device again does not entirely remedy the problem of the emission of large quantities of hot oil. This device operates in such a manner that the fuse holder must be removed in one quick instant to prevent the emission of large quantities of hot oil. Any moment of delay in either removing or replacing the fuse holder will allow the spring-loaded stopper to remain open and hot oil to flow from the transformer.

Other attempts to solve this problem include a hole located in the fuse holder housing that allows for the release of pressurized gas upon removal of the fuse holder. The hole is such that it extends from the interior of the fuse holder housing to the interior of the transformer tank. Upon removal of the fuse holder, pressurized gas can be released from the interior of the transformer through the hole and into the atmosphere. A potential problem exists here as it is entirely possible that the oil will have risen to such a level that it may cover the vent hole. This result will not lead to the emission of pressurized gas, but will instead result in the emission of hot oil.

The vent hole in such a device may be below the oil level in the transformer upon removal of the fuse holder for a number of reasons. As mentioned above, the oil level in the transformer will rise upon an increase in temperature inside the tank and a corresponding expansion of the oil's volume. The vent hole may be covered as a result of pad tilt. A transformer tank is intended to be on a level surface, but it may often be the case that the transformer is improperly positioned upon installation causing the device to be tilted.

It may also be the case that the ground under the tank may settle or move. Either of these two conditions present the possibility that the vent hole may be below the oil level when the operator removes the fuse holder. Thus, the potential still exists for a high velocity emission of hot oil.

Another attempt to prevent the emission of hot oil includes the use of a vent tube that can extend the vent hole described in the aforementioned device to a position higher than the location of the hole on the inside of the fuse housing. That is, the vent hole will still release pressurized gas or oil at a position within the fuse housing, but on the interior of the transformer, the vent tube will extend the positioning of the hole to a higher location.

Removal of the fuse housing in a transformer containing a vent tube as described above can still present a danger to the operator. The vent tube is still susceptible to oil entering it and emitting through the vent hole as the operator removes the fuse housing. An increase in volume of the oil or pad tilt can still cause the oil to flow into the vent tube and quickly emit through the fuse housing.

Accordingly, it is apparent that current fuse holder assemblies do not squarely solve the problem of the emission of hot oil upon removal of a bayonet-type fuse holder. Rather, each presents the possibility that a large amount of hot oil may still be lost upon fuse replacement with the further possibility of serious harm to the operator. This problem has created the need for a solution.

SUMMARY OF THE INVENTION

The fuse housing assembly of the present invention is designed to remedy the danger of the emission of hot oil or other dielectric liquid from an electrical transformer upon removal of a fuse holder from a bayonet-type fuse housing assembly. One presently preferred embodiment of the present invention achieves this goal by providing a fuse housing assembly which includes a rate release plug which allows for the emission of pressurized gas from the tank while at the same time, impeding the flow of liquid out of the tank.

Other aspects of the present invention are described below.

BRIEF DESCRIPTION OF THE DRAWINGS

The above-mentioned and other features and advantages of the invention will be apparent to those of ordinary skill in the art from the following detailed description of which.

DETAILED DESCRIPTION OF THE PREFERRED EMBODIMENTS

Figure 1:
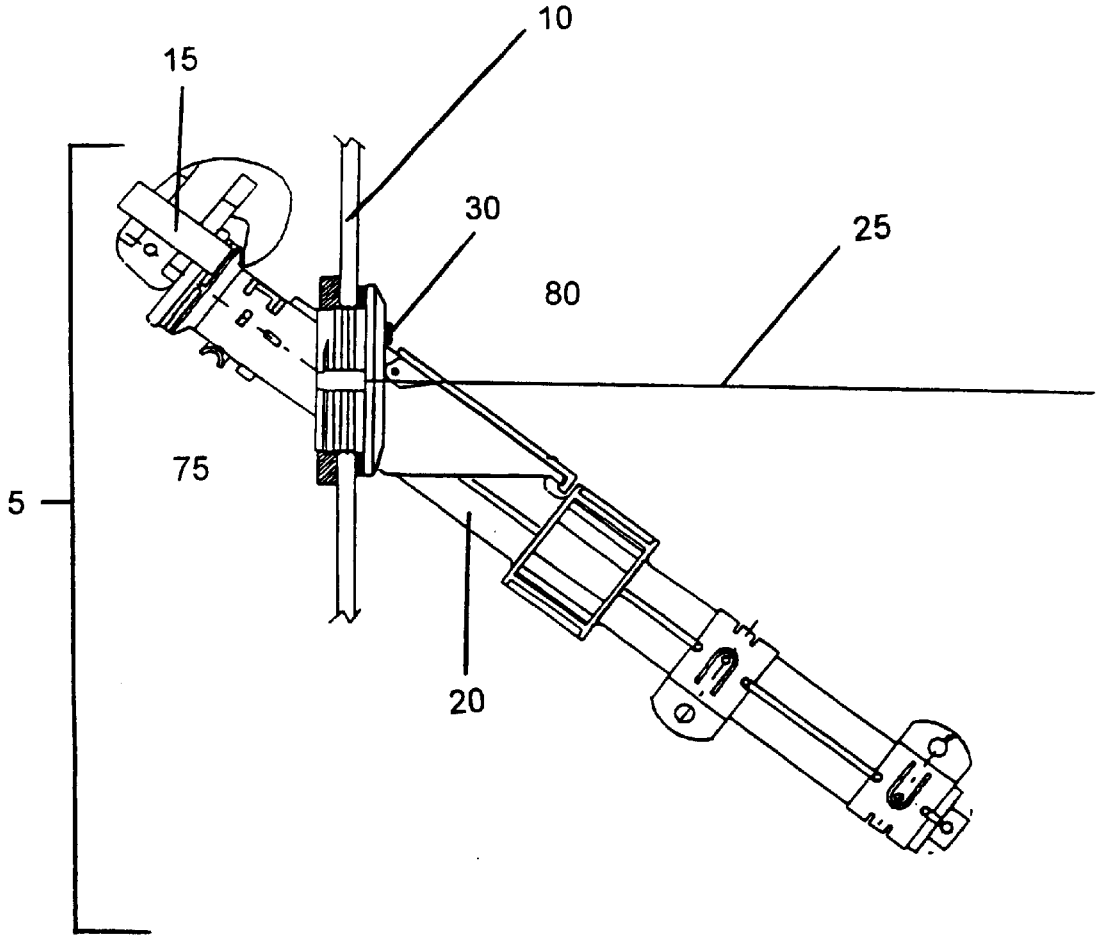
FIG. 1 is a side elevational view of a fuse housing assembly installed in a transformer wall according to one embodiment of the present invention.

The present invention can be better understood by reference to FIG. 1 which illustrates a preferred embodiment of the present invention. A transformer tank may contain a fuse housing assembly 5 to allow a fuse to operate inside the tank to protect against overload or overheating. A transformer tank may also contain dielectric fluid for insulating and cooling the tank. A typical fuse housing assembly will extend from the interior portion of the tank to the exterior portion of the tank and is mountable to the sidewall 10 of the transformer tank. Upon inserting a fuse holder 15, which contains the fuse, into the fuse holder housing 20, the fuse should be below the level of the dielectric oil 25 in the tank for ideal working conditions. The use and operation of a fuse housing assembly is well known to those skilled in the art as described, for example, in U.S. Pat. No. 5,204,654, the entire disclosure of which is incorporated by reference herein. Preferably, the embodiment of the present invention is used in conjunction with a type of bayonet fuse holder such as that described in U.S. Pat. No. 5,204,654, then entire disclosure of which is incorporated herein. It is anticipated that other variations of bayonet-type fuse assemblies can be used with the present invention as described herein.

Subsequent to the operation of a fuse in a fuse housing assembly, it is generally necessary to replace the fuse. This entails the removal of the fuse holder from the fuse holder housing 20. Because of the excessive heat and increased volume of the dielectric oil inside the transformer tank, it is possible that hot oil may be emitted through the opening in the tank at the location of the fuse holder housing 20.

The invention that is the subject of the present application concerns a fuse housing assembly 5 with a rate release plug used to prevent the emission of large quantities of hot oil from escaping through the fuse holder housing 20 upon removal of the fuse holder 15. With reference to FIG. 1, removal of the fuse holder 15 will break the seal between the fuse holder 15 and the fuse holder assembly allowing for the release of pressurized gas from inside the tank 80. The gas will vent from the interior of the tank through the vent hole 35 opening in the fuse holder housing that extends from the inner portion of the transformer tank to the interior of the fuse holder which is exposed to the outside atmosphere 75. In a preferred embodiment of the present invention, a vent plug is positioned in the vent hole 35 which allows for the release of pressurized gas from the interior of the tank 80 into the outside atmosphere 75, while at the same time impeding the flow of hot oil that may result upon removal of the fuse holder.

Figure 2:
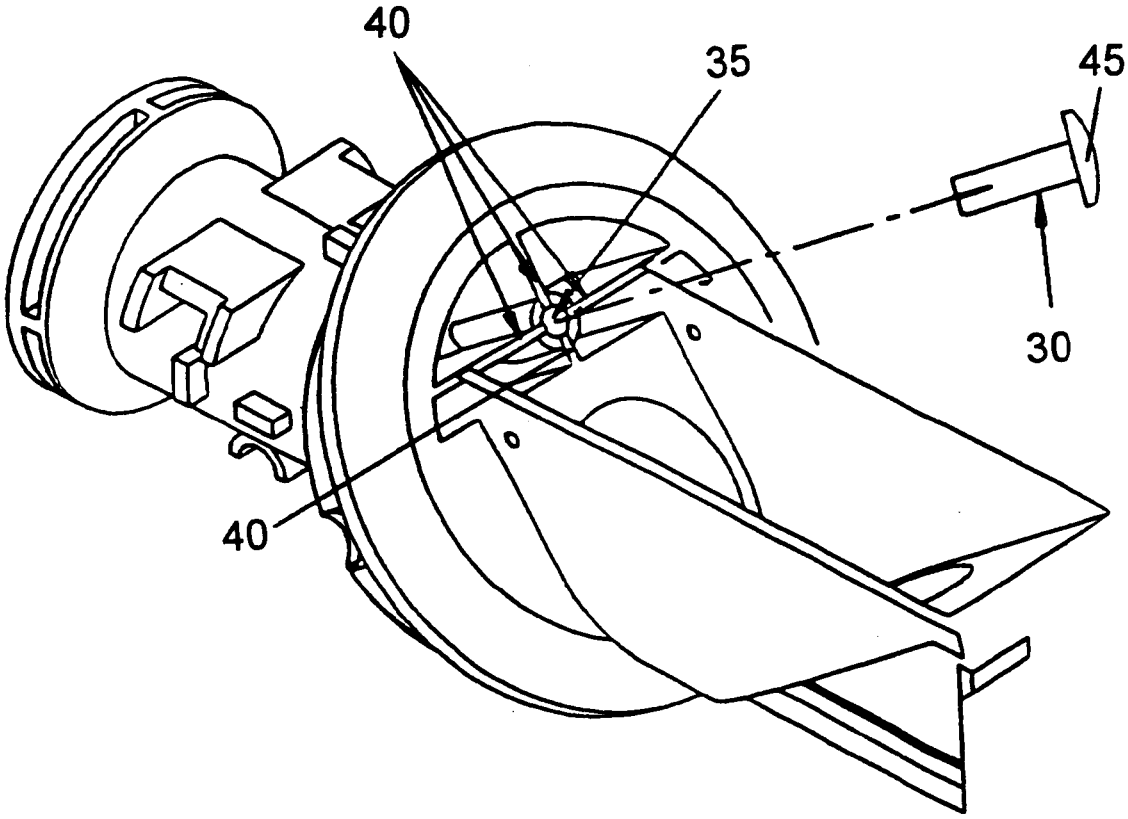
FIG. 2 is a partial perspective view of a portion of the fuse housing assembly according to one embodiment of the present invention, but without the vent plug in place.

FIG. 2 illustrates a portion of the fuse housing assembly of the present invention. Included is a depiction of the vent hole 35 with the vent plug removed. In the preferred embodiment of the present invention, the vent hole 35 is surrounded by stand-off ribs 40. In addition to providing structural support to the vent hole 35, the stand-off ribs 40 also minimally extend above the circular end of the vent hole 35 on the interior of the tank such that air may pass from the interior of the tank through the vent hole 35 with the vent plug in place. The vent plug of the present invention need not be permanently affixed inside the vent hole because of the high pressure on the inside of the transformer tank which will force the vent plug 30 in an outward direction away from the interior of the transformer tank. Even with a large amount of force being applied to the vent plug 30, the stand-off ribs 40 prevent the formation of a seal between the head 45 of the vent plug and the vent hole 35 on the interior of the transformer tank.

Figure 3:
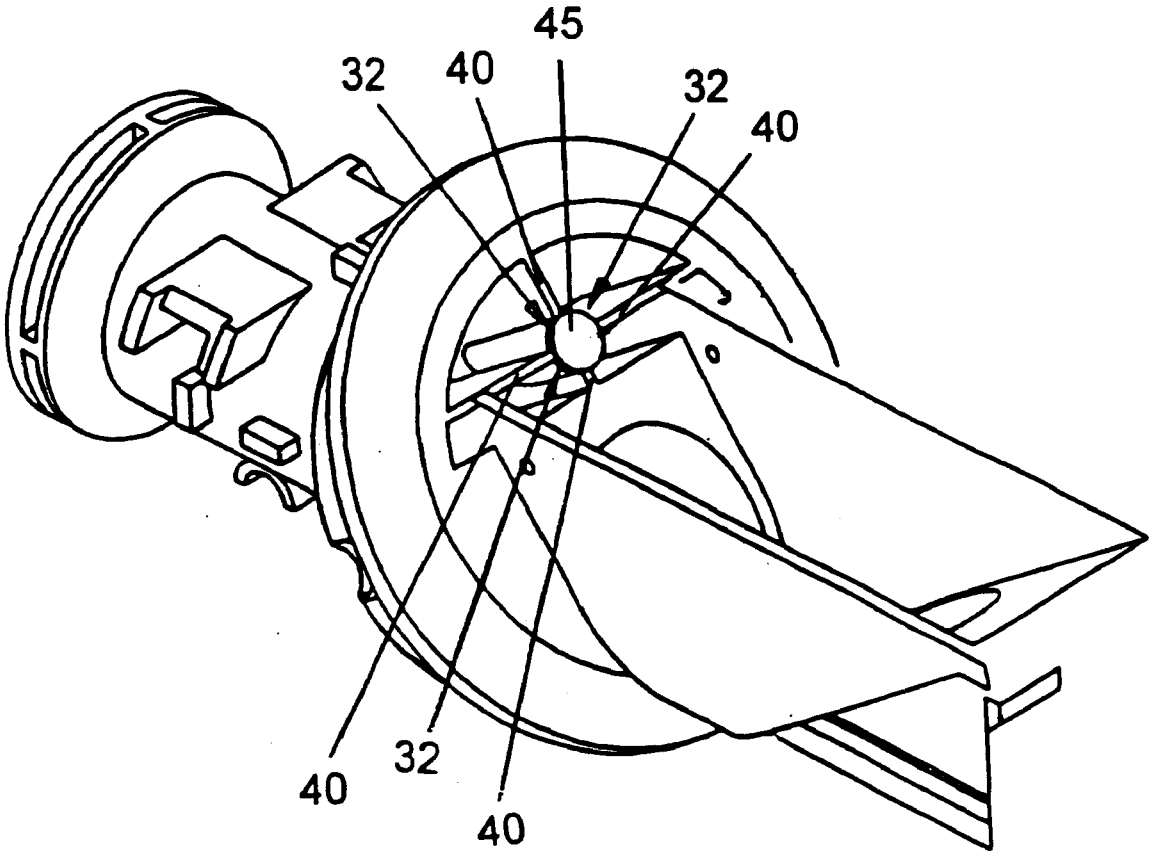
FIG. 3 is a partial perspective view of a portion of the fuse housing assembly according to one embodiment of the present invention with the vent plug in place.

FIG. 3 illustrates a portion of the fuse housing assembly of the present invention. Included is a depiction with the vent plug 30 in its functioning position. With the vent plug in place, pressurized air within the tank can flow through the vent hole 35 and into the outside atmosphere through the gas escapes 32 that are formed between the head 45 of the vent plug and the stand-off ribs 40. Because of the minimal space between the vent plug 30 and the vent hole 35, the flow of dielectric oil out of the transformer tank upon removal of the fuse holder will be impeded and thus minimized. In the event the oil level does rise above the level of the vent hole and vent plug, the emission of hot oil with use of the present invention will be limited to an amount similar to a slow drip. In other words, the possibility of the rapid emission of a stream of hot oil is no longer present.

Figure 4:
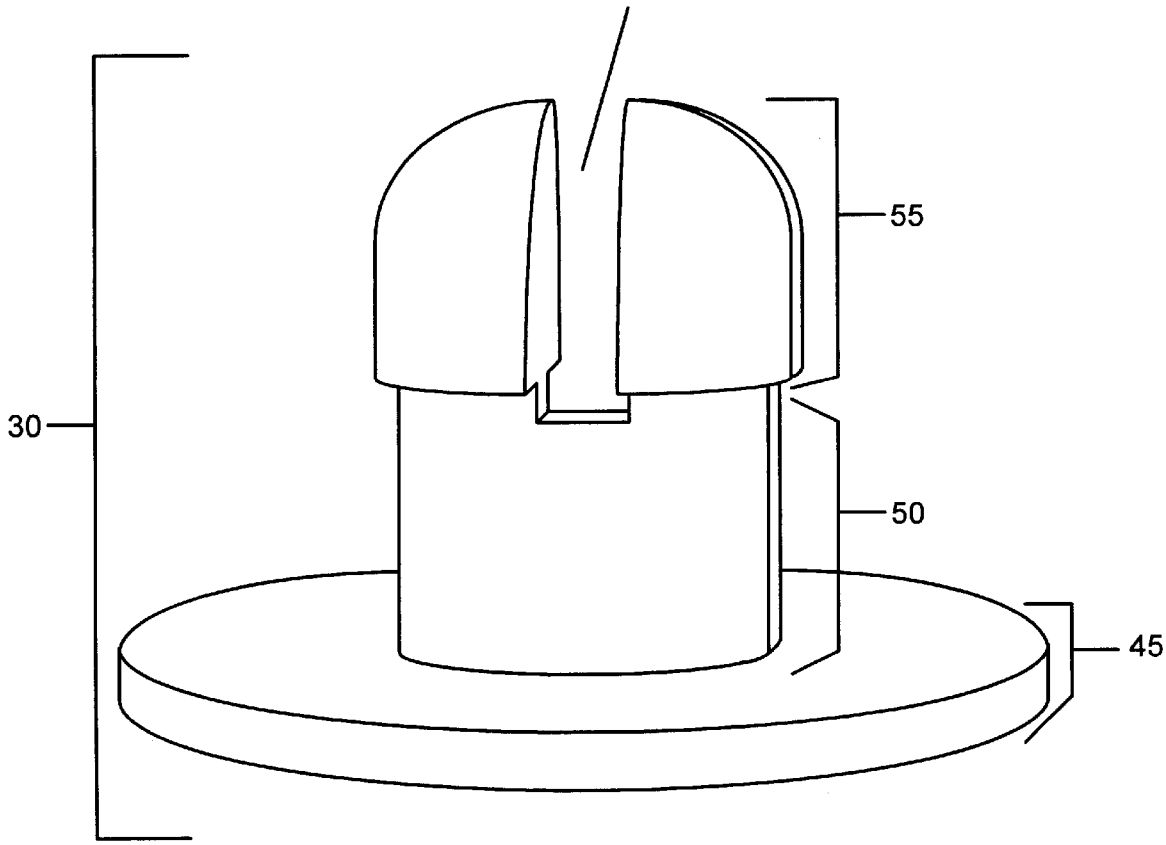
FIG. 4 is a perspective view of one embodiment of a vent plug.

FIG. 4 depicts a preferred embodiment of the vent plug 30 in accordance with the current invention. The vent plug 30 preferably has a cylindrical head 45. Attached to the head 45 is the body 50 of the vent plug 30. Preferably both the head 45 and body 50 of the vent plug 30 are cylindrical in shape. It is also preferred in the present invention that the diameter of the head 45 is larger than the diameter of the body 50. The distal end 55 of the vent plug 30 is defined as the end of the vent plug 30 that is attached to the body 50 and is furthest into the vent hole during operation. The distal end 55 of the preferred embodiment of the vent plug 30 has a larger cross-sectional diameter than the body 50 of the vent plug 30. The distal end 55 preferably has a cross-sectional diameter size that is substantially similar to the cross-sectional size of the vent hole. This allows for somewhat of a snug fit between the vent plug 30 and the vent hole such that the vent plug 30 remains positioned inside the vent hole.

The preferred embodiment of the vent plug 30 of the present invention also has a distal end 55 with an aperture 60 running perpendicular to the plane of the head 45 of the vent plug. The aperture 60 is preferably such that it extends entirely from the furthest point of the distal end opposite the body to a point within the body 50 of the vent plug. This results in an aperture that cuts entirely across the distal end 55, that is, it splits the distal end 55 into two pieces, both connected to the body of the vent plug 30. The width of the aperture 60 on the plane running parallel with the plane of the head of the vent plug 30 can be any of a number of sizes such that the vent plug 30 remains intact as a single piece. Because of the limited size range of the aperture 60, it will be of a size that permits the escape of air while at the same time impeding the flow of large quantities of oil.

Figure 5:
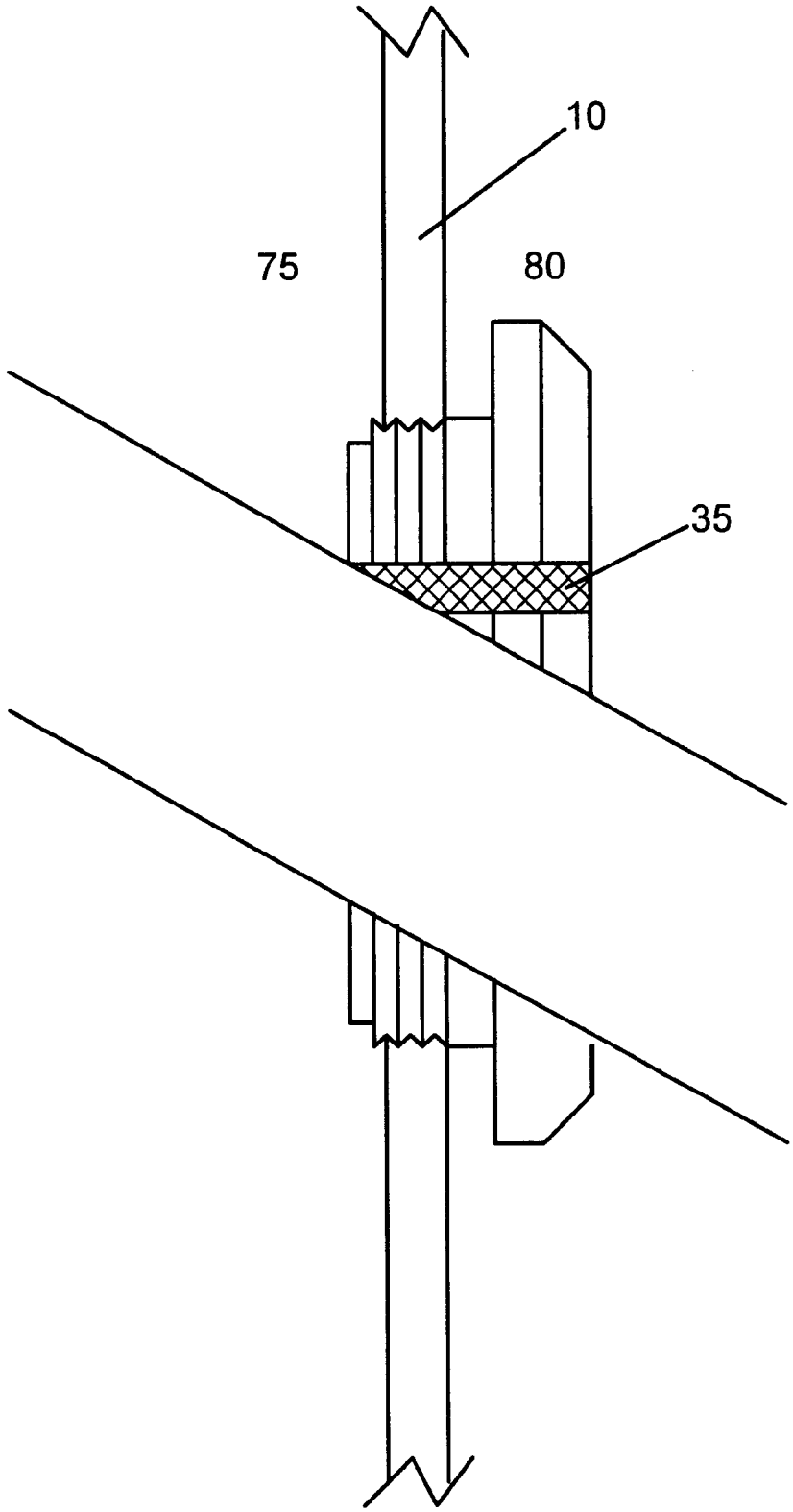
FIG. 5 is a partial sectional view of a fuse housing assembly installed in a transformer wall. The vent plug is not in place in this depiction.

FIG. 5 depicts a cross-sectional view of a portion of the fuse housing assembly with the vent plug removed. The transformer tank wall 10 is depicted as separating the outside atmosphere 75 from the interior of the tank 80. The vent hole 35 is shown as the cross-hatched portion of the figure. The depiction of the fuse housing assembly has been simplified for purposes of this illustration.

Figure 6:
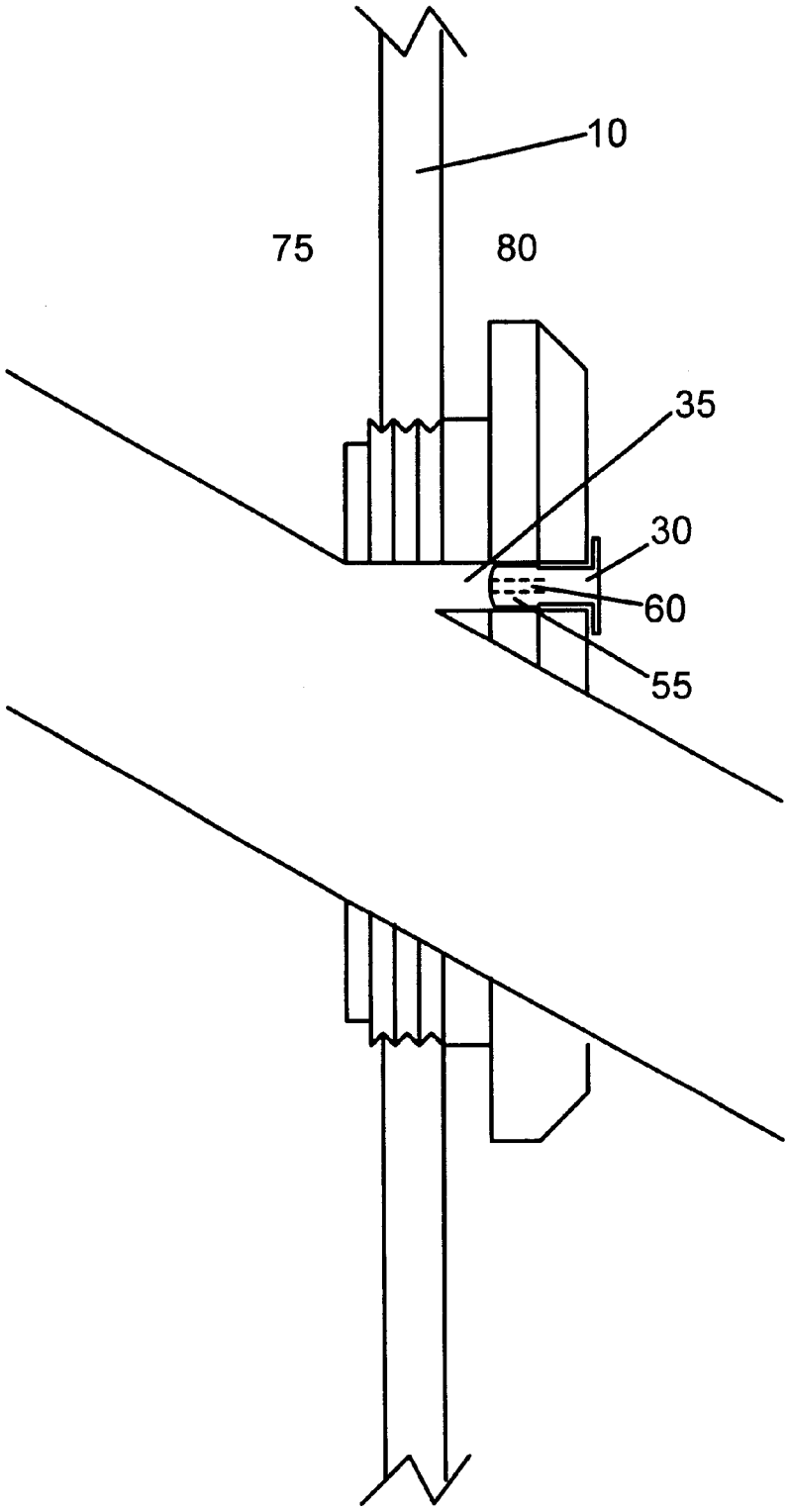
FIG. 6 is a partial sectional view of a fuse housing assembly installed in a transformer wall.

FIG. 6 depicts a cross-sectional view of a portion of the fuse housing assembly with the vent plug 30 in place. Again, the transformer tank wall 10 is depicted as separating the outside atmosphere 75 from the interior of the tank 80. Preferably the distal end 55 of the vent plug 30 maintains a snug fit with the interior portion of the vent hole 35 such that the vent plug 30 remains in place. The aperture 60 located in the distal portion 55 of the vent plug 30 is designated by the dashed lines on the vent plug. This aperture 60 allows for the flow of air from inside 80 the tank to the outside atmosphere 75 upon removal of the fuse holder.

Figure 7:
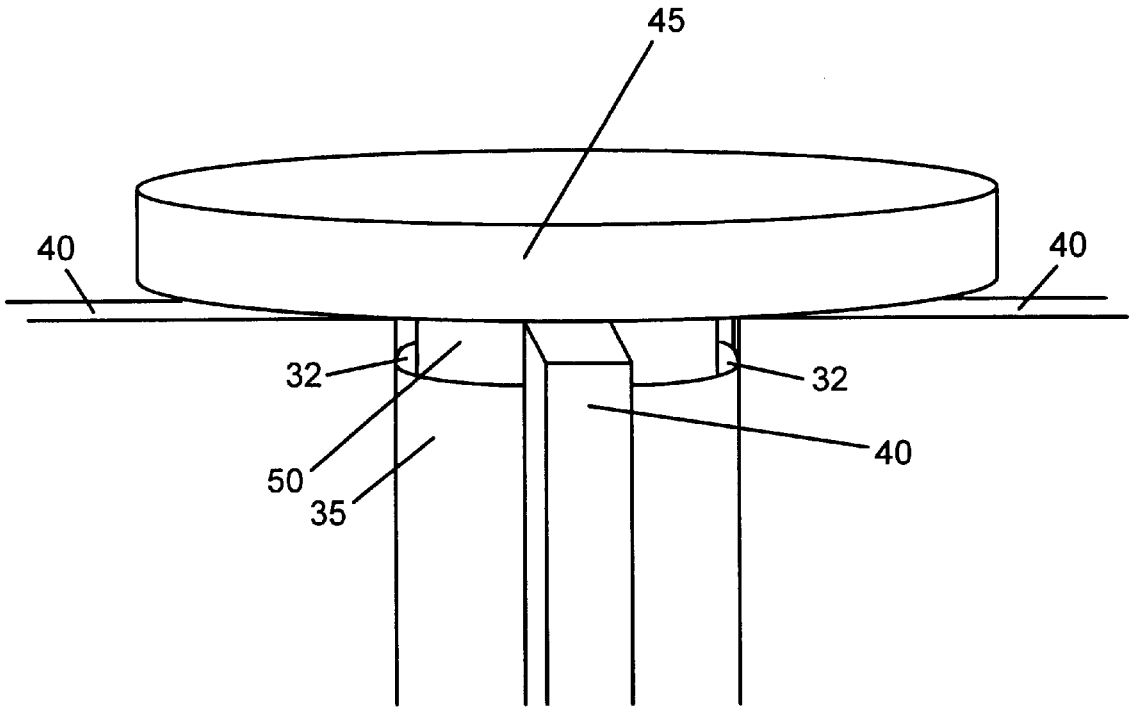
FIG. 7 is a partial perspective view of the vent plug in place in a fuse housing assembly.

FIG. 7 illustrates a close-up view of the head 45 of the vent plug in contact with the stand-off ribs 40 of the fuse holder assembly. The stand-off ribs 40 prevent the head 45 of the plug from forming a seal with the vent hole 35 when the transformer tank is operating under pressurized conditions. When the transformer tank is operating and the pressure inside the tank increases, force is applied to the vent plug in a direction toward the vent hole 35. Because of the presence of the stand-off ribs 40, the head 45 of the vent plug remains in a position off of the vent hole 35 and the pressurized air can escape from inside the tank through the gas escapes 32. Because of the minimal size of the gas escapes 32, the pressure within the tank may be reduced and any potential flow of hot oil out of the tank through the vent hole will be impeded and the risk of danger eliminated.

The scope of protection of the following claims is not intended to be limited to the presently preferred embodiments disclosed herein. Those skilled in the art will readily appreciate that many modifications can be made to the preferred embodiments described herein.

What is claimed is:

1. A fuse housing assembly, said fuse housing assembly being mountable in a tank, such that an inner portion is located on the interior of said tank and an outer portion is located on the exterior of said tank, said fuse housing assembly comprising:

a fuse holder housing capable of receiving a fuse holder that includes a fuse, said fuse holder housing having a first opening on said outer portion of said assembly for receiving said fuse holder and a second opening on said inner portion of said assembly for said fuse holder to access said interior of said tank;

a vent hole on said fuse holder housing extending from an opening on the inside of said fuse holder housing to an opening on said interior of said tank, at least one stand-off rib surrounding said vent hole at said opening on said interior of said tank, and a vent plug, to impede the flow of liquid though said vent hole, positioned within said vent hole at said opening on said interior of said tank.

2. The fuse housing assembly of claim 1 wherein said vent plug comprises a cylindrical head attached to a cylindrical body.

3. The fuse housing assembly of claim 2 wherein said cylindrical body of said vent plug has a distal end with a larger cross-sectional diameter than the remainder of the body.

4. The fuse housing assembly of claim 3 wherein said distal end of said vent plug has an aperture running perpendicular to the plane of said head of said vent plug.

5. A fuse housing assembly, said fuse housing assembly being mountable in a tank, such that an inner portion is located on the interior of said tank and an outer portion is located on the exterior of said tank, said fuse housing assembly comprising:

a fuse holder housing capable of receiving a fuse holder that includes a fuse, said fuse holder housing having a first opening on said outer portion of said assembly for receiving said fuse holder and a second opening on said inner portion of said assembly for said fuse holder to access said interior of said tank;

a vent hole on said fuse holder housing extending from an opening on the inside of said fuse holder housing to an opening on said interior of said tank; and means for impeding a flow of liquid through said vent hole.

* * * * *

UNITED STATES PATENT AND TRADEMARK OFFICE

CERTIFICATE OF CORRECTION

PATENT NO. : 6,624,736 B1
DATED : September 23, 2003
INVENTOR(S) : Cotton et al.

It is certified that error appears in the above-identified patent and that said Letters Patent is hereby corrected as shown below:

Drawings,
Sheet 4, Fig. 4, the reference numeral "60" should be applied to the aperture.

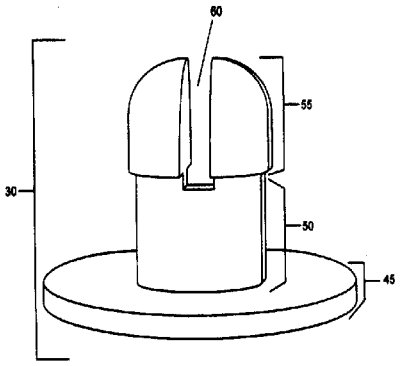

FIG. 4

Signed and Sealed this

Twentieth Day of January, 2004

JON W. DUDAS
*Acting Director of the United States Patent and Trademark Office*